United States Patent [19]

Fleury

[11] Patent Number: 4,590,447

[45] Date of Patent: May 20, 1986

[54] DELAY LINE OF THE CEILING AND RING TYPE OR OF THE CEILING AND BAR TYPE

[75] Inventor: Georges Fleury, Sevres, France

[73] Assignee: Thomson-CSF, Paris, France

[21] Appl. No.: 521,239

[22] Filed: Aug. 8, 1983

[30] Foreign Application Priority Data

Aug. 13, 1982 [FR] France ..... 82 14101

[51] Int. Cl.[4] ..... H01P 9/00; H01J 23/30

[52] U.S. Cl. ..... 333/156; 315/3.5; 315/39; 333/157; 333/251

[58] Field of Search ..... 333/156, 157, 251; 315/3.5, 3.6, 39

[56] References Cited

U.S. PATENT DOCUMENTS

| | | | |
|---|---|---|---|
| 3,181,024 | 4/1965 | Sensiper | 315/3.5 |
| 3,221,204 | 11/1965 | Hant et al. | 315/3.5 |
| 3,221,205 | 11/1965 | Sensiper | 315/3.5 |
| 3,354,347 | 11/1967 | Hant | 315/3.5 |
| 3,360,679 | 12/1967 | Rubert | 315/3.5 |
| 3,993,924 | 11/1976 | Hanf | 315/3.5 |

FOREIGN PATENT DOCUMENTS

| | | |
|---|---|---|
| 972702 | 2/1952 | France . |
| 1107515 | 1/1956 | France . |
| 1148521 | 12/1957 | France . |
| 2088966 | 1/1972 | France . |
| 2275017 | 1/1976 | France . |

OTHER PUBLICATIONS

Nachrichtentechnische Zeitung vol. 30, No. 12 Dec. 1977, pp. 912–916.

*Primary Examiner*—Marvin L. Nussbaum
*Attorney, Agent, or Firm*—Roland Plottel

[57] ABSTRACT

To ensure stability of tubes comprising a delay line of the ceiling and ring type or of the ceiling and bar type, resonating slits are disposed in the ceilings of the line.

15 Claims, 9 Drawing Figures

FIG_8-a

FIG_8-b

DELAY LINE OF THE CEILING AND RING TYPE OR OF THE CEILING AND BAR TYPE

BACKGROUND OF THE INVENTION

1. Field of the Invention

The present invention relates to a delay line of the ceiling and ring type or of the ceiling and bar type for a travelling wave tube.

2. Description of the Prior Art

These two types of lines are now well known in the prior art. It is known in particular that these lines may propagate several modes: a principal mode and several parasite modes.

To ensure stability of the travelling wave tubes using these lines it is necessary:

- on the one hand, to suppress the propagation of the parasite modes;
- on the other hand, for the principal mode, to avoid parasite oscillations which are troublesome, whether the tube operates as an amplifier or as an oscillator.

In the prior art, the stability of travelling wave tubes comprising a ceiling and ring line is provided in the following way:

- for the parasite modes, on some rings is deposited a metal layer or a layer of an alloy such as Kanthal, (registered trademark), formed of aluminium, iron . . .
- for the principal mode, one or more cuts are made in the delay line and each line portion is connected to power loads provided with a cooling system; moreover, a deposit, of Kanthal for example, is made on some of the feet supporting the rings so as to "mask" by distributed losses of a few decibels the standing wave ratio or ROS due to these cuts.

The problems which arise from these techniques used in the prior art and which our invention proposes resolving are the following:

- the metal or alloy layers covering some rings are efficient but generate high frequency losses in the principal mode, and so reduce the gain and the efficiency of the tube;
- and especially, the use of loads external to the tube requires the provision of transitions between the delay line and coaxial lines, coaxial windows, cooling systems for the power loads . . . . All these elements are costly and space-wasting: moreover, the passage of coaxial lines through the winding of the solenoid, which provides focusing of the electron beam along the axis of the tube, creates breakages of the solenoid which generate disturbances in the focusing of the beam.

Similar problems arise for practically all tubes comprising ceiling and bar lines, where substantially the same techniques are used to ensure stability.

The object of the present invention is to resolve the above-mentioned problems and in particular to suppress the loads external to the tubes.

SUMMARY OF THE INVENTION

According to claim 1, the present invention relates to a delay line of the ceiling and ring type or of the ceiling and bar type for a travelling wave tube formed by a succession of cells along the axis of the tube, which comprises resonating slits disposed in the ceilings between two consecutive cells. In a preferred embodiment of the invention, the line also comprises resonating slits on at least one of the elements of the line, such as the feet connected to the rings and their supports or such as the fingers and their supports, these slits being situated substantially in the plane of a ring.

The resonating slits disposed in the rings prevent high frequency currents from flowing between the cells of the delay lines. The influence of the depth of the slits is used for selecting the attenuated frequencies. These slits disposed on the ceilings cannot be active at the frequencies at which there is little or no current flowing through the ceilings between the cells, i.e. towards the low cut-off frequencies. At these frequencies, it is the slits disposed in the elements of the line, such as the feet connected to the rings and their supports or such as the fingers and their supports, which become active. If there is no current flow between the cells, currents then flow within the cells, for example between the rings and the ceilings through the feet.

BRIEF DESCRIPTION OF THE DRAWINGS

Other objects, features and results of the invention will be clear from the following description given by way of non limiting example and illustrated by the accompanying figures which show:

FIGS. 8*a* and 8*b*, a longitudinal section and a cross section of a ceiling line according to one embodiment of the invention.

In the different figures, the same references designate the same elements but, for the sake of clarity, the sizes and proportions of the different elements have not been respected.

DESCRIPTION OF THE PREFERRED EMBODIMENTS

Figure 1:
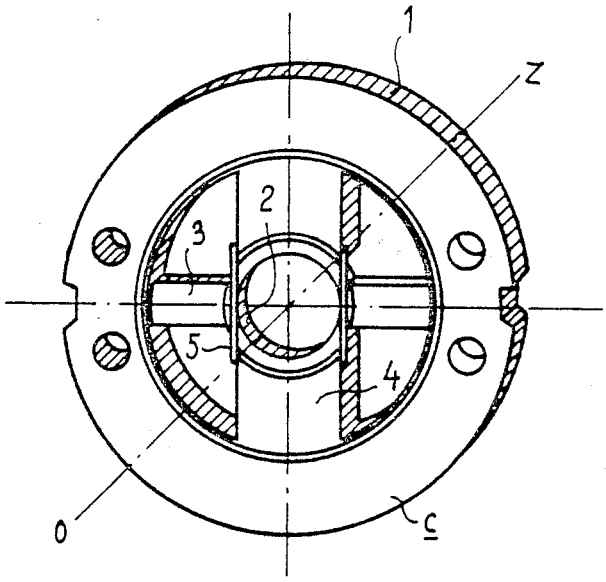
FIGS. 1 and 2, a cross section and a longitudinal section of a delay line of the ceiling and ring type of the prior art.
Figure 2:
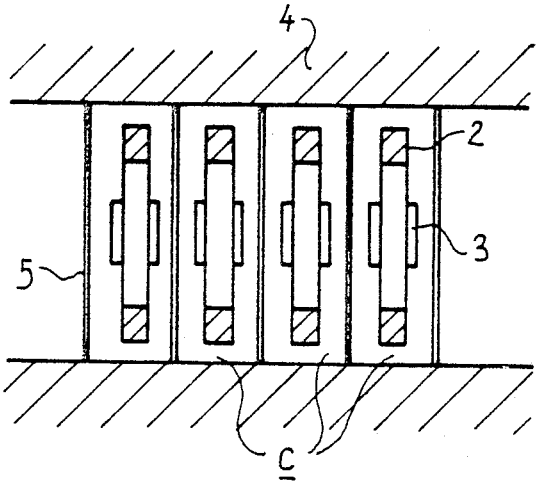

FIGS. 1 and 2 show a cross section and a partial longitudinal section of a ceiling and ring delay line.

Ceiling and ring delay lines are well known in the prior art, particularly from French Pat. No. 1 162 425 and its certificate of addition No. 82 236.

These lines may be formed by a metal guide 1, cylindrical for example, with in the cross sections of this guide metal coaxial rings 2. Each ring is fixed to the wall of the guide by at least one metal rod 3. In the example of FIGS. 1 and 2, the rings are held by two diametrically opposite rods which are often called the feet of the rings. This line further comprises at least one ceiling 4 formed by a metal strut fixed to the inner wall of the guide and extending over the whole length of the guide. Any section of this ceiling through a plane perpendicular to axis Oz of the guide has the form of a circular ring sector. In the example of FIGS. 1 and 2, two ceilings 4 are used. These ceilings extend symmetrically from the wall of the guide to a certain distance from the center of the cross section thereof.

These ceiling and ring lines appear then as formed by a succession of elementary portions or cells C, generally identical and which are repeated periodically along axis Oz.

In FIGS. 1 and 2, each cell is formed by a ring 2, supported by two feet 3, two ceilings 4 and a waveguide portion 1.

These lines may propagate a principal mode and several parasite modes. In the above-mentioned certificate of addition, it is provided, when the line comprises several ceilings, to connect these ceilings electrically together by a simple metal wire, often called strap. Thus the parasite modes are shifted to frequencies situated outside the operating band of the tube in the principal mode. For example, for a tube operating in the band S, at about 3 Gigahertz, the parasite modes are generally shifted to about 6 Gigahertz.

In FIGS. 1 and 2, reference 5 designates the straps which connect the ceilings together.

It was previously mentioned that, to ensure stability of travelling wave tubes using ceiling and ring delay lines, attempts have been made to suppress the propagation of the parasite modes and to avoid parasite oscillations in the principal mode.

Figure 3:
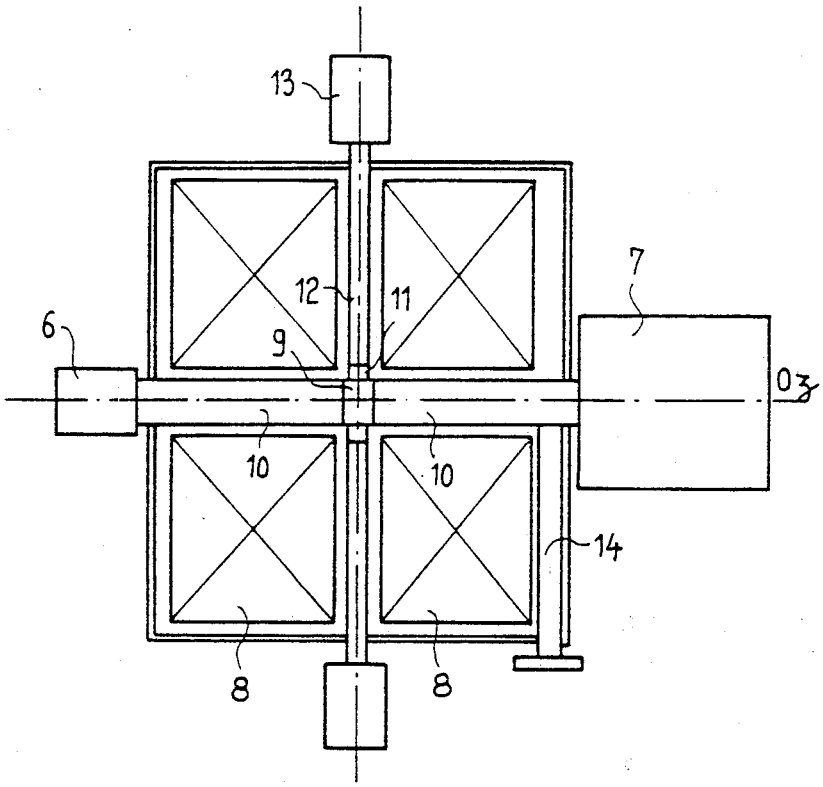
FIG. 3, a longitudinal section of a travelling wave tube comprising a ceiling and ring line and showing how stabilization of the principal mode is achieved in the prior art.

We have seen that, to suppress parasite modes, metal or alloy deposits are formed on some rings. For the principal mode, several cuts are made in the delay line and each line portion is matched by means of power loads. FIG. 3 is a longitudinal section showing symbolically a travelling wave tube comprising a ceiling and ring line and illustrating the way in which stabilization of the principal mode is achieved in the prior art.

Reference 6 designates the electron gun of the travelling wave tube, 7 its collector and 8 the device for focusing the electron beam emitted by the gun, along axis Oz of the tube. This focusing device is generally formed by a solenoid.

The ceiling and ring delay line 10 is separated into two separate portions by a piece 9, having an orifice for letting the electron beam pass therethrough. The portion connected to the gun is connected, by means of a coaxial line 12 comprising a vacuum-tight window 11, to a power load 13 having a cooling system. The coaxial line 12 passes through the focusing device and it is then necessary to use a two-part solenoid. The delay line portion which is connected to the collector is connected to an energy output waveguide 14.

As already mentioned, separation of the line into portions matched by loads external to the tube requires the positioning of different space-consuming and costly elements and disturbs the focusing of the beam.

Figure 4:
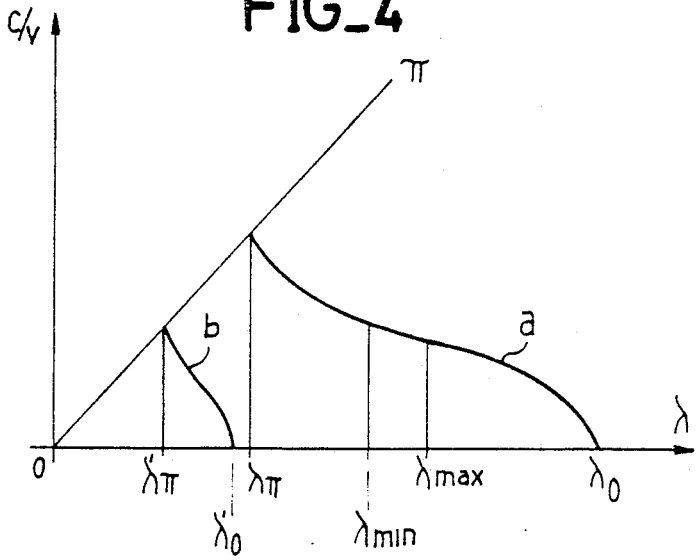
FIG. 4, the dispersion diagram, $c/v=f(\lambda)$, of a travelling wave tube comprising a ceiling and ring delay line of the prior art.

In FIG. 4 is shown the dispersion diagram of a ceiling and ring delay line such as the one shown in FIGS. 1 and 2. This diagram represents the delay rate c/v with c speed of the light and v phase speed of the wave, as a function of the wavelength $\lambda$. This delay line may propagate more especially, among others, a principal mode a and a parasite mode b; because of the presence of the straps, the propagation band of the parasite mode is shifted outside the propagation band of the principal mode.

There is designated respectively by $\lambda_o$ and $\lambda_\pi$ the low and high cut-off wavelengths of the principal mode and by $\lambda'_o$ and $\lambda'_\pi$ those of the parasite mode. Moreover, $\lambda_{min}$ and $\lambda_{max}$ designate the boundaries of the useful band of the principal mode.

Figure 5:
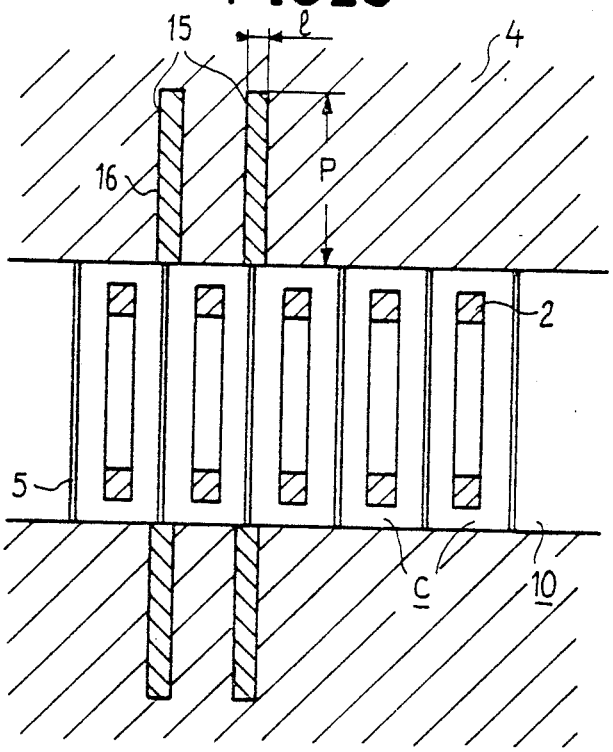
FIGS. 5, 6 and 7, a longitudinal section and two cross sections of a ceiling and ring delay line according to different embodiments of the invention.

FIG. 5 is a partial longitudinal section of a delay line of the ceiling and ring type according to one embodiment of the invention.

Resonating slits 15 are disposed in the ceilings 4 of line 10.

In FIG. 5, these slits are disposed in vertical alignment with the straps 5 which connect the ceilings together and substantially in the middle of the waveguide portion which separates two consecutive cells, each cell C being formed by a ring supported by two feet and a waveguide portion and ceilings. What is important is for the slits 16 to be disposed between the cells and not in the cells, in which case they would be in vertical alignment with the rings and would not intercept any current except for the low cut-offs $\lambda_o$ and $\lambda'_o$.

Except for the low cut-offs $\lambda_o$ and $\lambda'_o$, high frequency currents flow between the cells C of the line by passing through the ceilings. These currents are maximum when the phase-shift between two consecutive cells is equal to $\pi$, i.e; of the high cut-offs $\lambda_\pi$ and $\lambda'_\pi$.

Slits 15 are disposed perpendicular to the ceilings 4 of the line. The depth p of these slits is chosen so that they resonate and form short-circuits which prevent high frequency currents from flowing in the ceilings at some frequencies. These slits are given a depth p equal to $(2n+1).\lambda/4$, where n is an integer and $\lambda$ takes on different values. To attempt to suppress the parasite mode b, $\lambda$ is chosen substantially equal to the high cut-off wavelength of the parasite mode b. Slits tuned at about $\lambda_\pi$ are then disposed every 5 to 10 cells, so as to attenuate the parasite mode where there might be oscillation. These slits are little damped, i.e. they operate in a small band centered about $\lambda'_\pi$. So as to attempt to stabilize the principal mode, $\lambda$ is chosen substantially equal to the lowest wavelength $\lambda_{min}$ of the useful band $\lambda_{min}$, $\lambda_{max}$ of the principal mode a. Then some slits, two to eight for example, are disposed at position on the delay line where in the prior art cuts were provided in the line as shown in FIG. 3. These slits are tuned to about $\lambda_{min}$ and they are very much damped so as to cover a wide band.

Stabilization of the principal mode is more particularly useful when the tube operates as an amplifier, with modulation by the cathode. In this case, the cathode voltage varies from zero to the nominal voltage at each pulse and the operating point of the tube moves each time in the dispersion diagram along the axis of the ordinates c/v of FIG. 4, from infinity to zero. The risks of oscillation in particular between $\lambda_\pi$ and $\lambda_{min}$ are greater than when the tube is operating as an amplifier with modulation by the grid or without modulation, for the position of the operating point along axis c/v does not vary.

To tune the slits and to obtain the desired stability in addition to the depth p, the following characteristics may be acted on:

- the width 1 of the slits. That allows the coupling between the delay line and the resonating circuits which the slits form to be varied. By varying the width of the slits, there is greater or lesser attenuation at the selected frequencies;
- these slits may be filled with an absorbent dielectric material 16 as shown in FIG. 5. To better dissipate the power absorbed by this material, this material may be brazed to the slit. The presence of a dielectric material allows the resonating circuit formed by each slit to be damped. The attentuation due to this slit is distributed over a wide frequency band;

to vary the frequency at which the attenuation of a given slit is maximum, the depth p may be varied but also the dielectric constant k of the absorbent material used;

to vary the value of the attenuation, we have seen that it is possible to vary the width 1 of the slits, but it is also possible to vary the loss angle of the dielectric material used:

the slits may be disposed symmetrically in the ceilings or not. In FIG. 5, four slits have been shown which are diametrically opposed in pairs.

It is possible to give the different characteristics mentioned: width of the slits—depth of the slits—dielectric constant and loss angle of the absorbent material which fills the slits . . . values which vary, progressively or not, along the delay line.

The invention allows the stability of the tubes to be provided without using very troublesome external loads. It is possible to associate the slits of the invention with the metal or alloy deposits on rings or feet which are used in the prior art. The invention also allows, in some cases, to do away with the straps.

To improve the stability of the tubes by increasing the attenuation at low cut-offs $\lambda_o$ and $\lambda'_o$, resonating slits are disposed for example in the feet 3 of the rings and/or in the supports of these feet, but still substantially in the plane of the rings. The supports of the feet are in fact, in the case of the lines shown in FIGS. 1 and 2, the waveguide 1.

Figure 6:
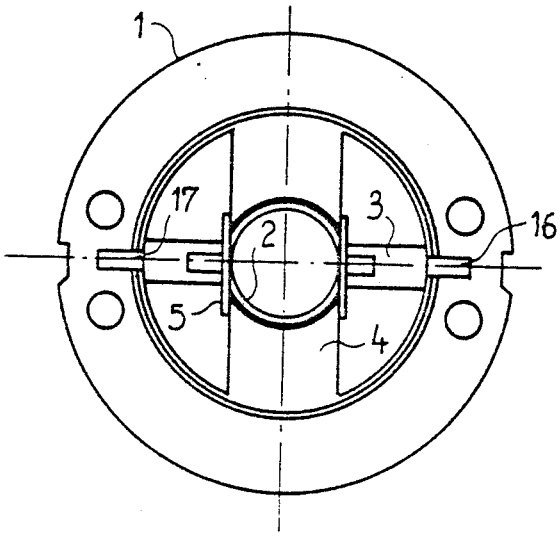
Figure 7:
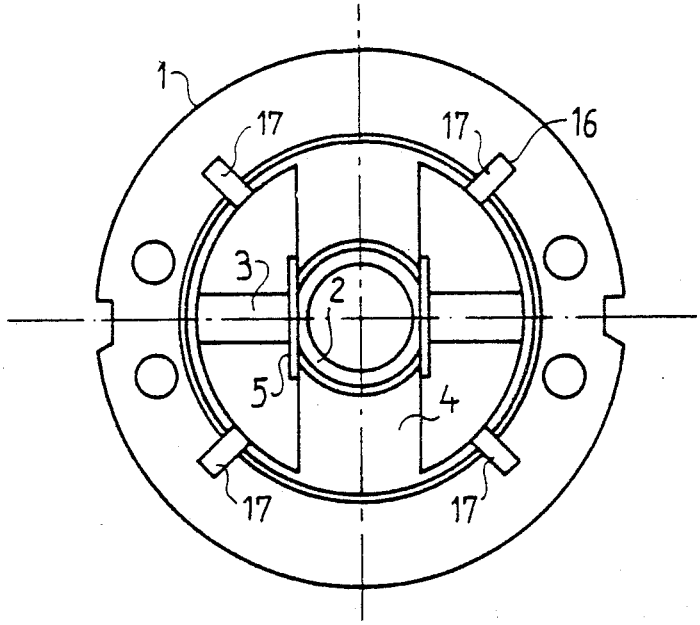
Figure 7:
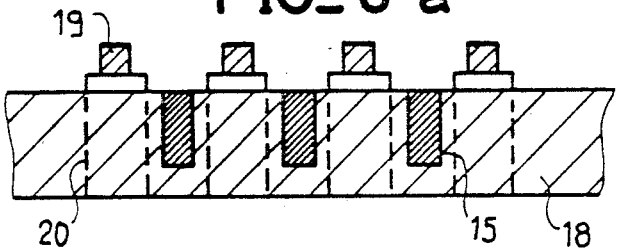
Figure 7:
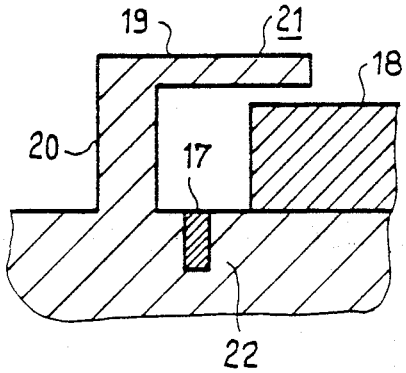

FIGS. 6 and 7 show cross sections of ceiling and ring delay lines provided with resonating slits elsewhere than in the ceilings. In FIG. 6, four slits have been shown diametrically opposed in pairs: two in the feet 3, two in the guide 1 and still substantially in the plane of a ring. In FIG. 7, four slits have been shown diametrically opposed and offset by 90°, situated in the guide 1 and in the plane of the ring.

At low cut-offs $\lambda_o$ and $\lambda'_o$, there is no current flow between the cells, but currents flow in each cell between the rings and the ceilings through the feet.

By disposing slits perpendicularly at the surface of the feet or of the waveguide, i.e. in a plane passing through the axis Oz of the tube and substantially in the plane of the rings, a part of these currents may be attenuated.

Like the slits disposed in the ceilings, slits 17 disposed in the feet and/or the waveguide 1 and substantially in the plane of the rings, may be tuned to different frequencies so as to influence the principal mode or the parasite mode.

Thus, for suppressing the parasite mode, slits 17 are tuned to about the low cut-off wavelength $\lambda'_o$ of the parasite mode and are little damped. For stabilizing the principal mode, slits 17 are tuned to about the low cut-off wavelength $\lambda_o$ of the principal mode and are very greatly damped.

Thus, to tune slits 17, their depth p is acted on. This depth is chosen equal to $(2n+1).\ \lambda/4$:

where n is an integer;

where $\lambda$ is substantially equal to $\lambda_o$ or $\lambda'_o$, depending on whether it is the principal mode or the parasite mode which is acted on.

As mentioned above, in the case of slits disposed in the ceilings, tuning of slits 17 may also be achieved by acting on their width 1, the presence or not of an absorbent dielectric material 17 and the characteristics such as the dielectric constant k or the loss angle of this material, the symmetrical arrangement of the slits or not . . . All that has been said about the different ways of matching the slits disposed in the ceilings applies to the slits disposed in the feet or the guide.

The invention has been more particularly described in the case of ceiling and ring delay lines, comprising two ceilings having straps and two feet per ring. The invention applies of course to all ceiling and ring delay lines whatever the number of ceilings, feet and whether there are straps or not.

The invention also applies to ceiling and bar delay lines, such for example as multi-wire ceiling lines or interdigited ceiling lines.

For example, in FIGS. 8*a* and 8*b*, there has been shown by way of example a longitudinal section and a cross section through xy of a ceiling line.

The reference 18 designates the ceiling, 19 and 20 the two parts of fingers 21. In this type of line, a cell is formed, for example, as shown in FIG. 8*b* by a finger 21, a ceiling portion 18 and a support portion 22.

According to the invention, resonating slits 15 are disposed in the ceiling 18 to intercept the currents flowing from one cell of the line to the next, that is to say that these slits are disposed in the part of the ceiling 18 situated between two fingers 21, as shown in FIG. 8*a* and not in the plane of a finger. Resonating slits 17 are disposed in the supports 22, in the plane of the fingers, as shown in FIG. 8*b*, to intercept the current flowing in each cell.

The delay lines of the invention are used in type O or M travelling wave tubes.

I claim:

1. In a delay line of the ceiling and ring type for a travelling wave tube formed by a succession of cells along the axis of the tube each cell being formed in the delay line of the ceiling and ring type by a ring supported by at least one foot, at least one ceiling and a waveguide portion, said lines being allowed to propagate several modes, a principal mode and several parasite modes, each mode having low and high cut-off wavelengths, wherein resonating slits are provided disposed in the ceilings between two consecutive cells.

2. The delay line as claimed in claim 1, wherein resonating slits are provided in at least one of the elements of the line, such as the feet connected to the rings and their supports or such as the fingers and their supports, these slits being situated substantially in the plane of a ring.

3. The delay line as claimed in claim 1, wherein the resonating slits, disposed in the ceilings, are tuned for suppressing the parasite modes to about the high cut-off wavelengths of the parasite modes, and, for stabilizing the principal mode, to about the lowest wavelength of the useful band.

4. The delay line as claimed in claim 2, wherein the resonating slits, disposed in at least one of the elements of the line, such as the first connected to rings, and their supports are tuned for suppressing the parasite modes, to about the low cut-off wavelengths of the parasite modes, and for stabilizing the principal mode, to about the low cut-off wavelength of the principal mode.

5. The delay line as claimed in claim 3, wherein tuning of the slits is achieved by acting on their depth which is equal to $(2n+1).\ \lambda/4$, where n is an integer, and where $\lambda$ takes on different values such as the high cut-off wavelengths of the parasite modes, the lowest wavelength of the useful band, the low cut-off wavelengths of the parasite modes or of the principal mode.

6. The delay line as claimed in claim 4, wherein tuning of the slits is achieved by acting on their depth which is equal to $(2n+1)\cdot\lambda/4$, where n is an integer and where $\lambda$ takes on different values such as the high cut-off wavelengths of the parasite modes, the lowest wavelength of the useful band, the low cut-off wavelengths of the parasite modes or of the principal mode.

7. The delay line as claimed in claim 3, wherein tuning of the slits is made by acting on the following characteristics:

the width of the slits;

the presence of an absorbent dielectric material in the slits;

the characteristics of this material such as its dielectric constant or its loss angle;

the symmetrical or not arrangement of the slits.

8. The delay line as claimed in claim 4, wherein tuning of the slits is achieved by acting on the following characteristics:

the width of the slits;

the presence of an absorbent dielectric material in the slits;

the characteristics of this material such as its dielectric constant or its loss angle;

the symmetrical or not arrangement of the slits.

9. The delay line as claimed in claim 5, wherein tuning of the slits is achieved by acting on the following characteristics:

the width of the slits;

the presence of an absorbent dielectric material in the slits;

the characteristics of this material such as its dielectric constant or its loss angle;

the symmetrical or not arrangement of the slits.

10. The delay line as claimed in claim 6, wherein tuning of the slits is achieved by acting on the following characteristics:

the width of the slits;

the presence of an absorbent dielectric material in the slits;

the characteristics of this material such as its dielectric constant or its loss angle;

the symmetrical or not arrangement of the slits.

11. In a delay line of the ceiling and bar type for a travelling wave tube formed by a succession of cells along the axis of the tube each cell being formed in the delay line of the ceiling and bar type by a finger, a ceiling portion, and a support portion of the finger, said lines being allowed to propagate several modes, a principal mode and several parasite modes, each mode having low and high cut-off wavelengths, wherein resonating slits are provided disposed in the ceilings between two consecutive cells.

12. The delay line as claimed in claim 11, wherein the resonating slits, disposed in the ceilings, are tuned for suppressing the parasite modes to about the high cut-off wavelengths of the parasite modes, and, for stabilizing the principal mode, to about the lowest wavelength of the useful band.

13. The delay line as claimed in claim 12, wherein the resonating slits, disposed in at least one of the elements of the line, or such as the fingers and their supports, are tuned for suppressing the parasite modes, to about the low cut-off wavelengths of the parasite modes, and for stabilizing the principal mode, to about the low cut-off wavelength of the principal mode.

14. The delay line as claimed in claim 12, wherein tuning of the slits is made by acting on the following characteristics:

the width of the slits;

the presence of an absorbent dielectric material in the slits;

the characteristics of this material such as its dielectric constant or its loss angle;

the symmetrical or not arrangement of the slits.

15. The delay line as claimed in claim 13, wherein tuning of the slits is achieved by acting on the following characteristics:

the width of the slits;

the presence of an absorbent dielectric material in the slits;

the characteristics of this material such as its dielectric constant or its loss angle;

the symmetrical or not arrangement of the slits.

* * * * *